United States Patent [19]

Nguyen

[11] Patent Number: 5,016,707

[45] Date of Patent: May 21, 1991

[54] MULTI-PASS CROSSFLOW JET IMPINGEMENT HEAT EXCHANGER

[75] Inventor: Dam C. Nguyen, Rockford, Ill.

[73] Assignee: Sundstrand Corporation, Rockford, Ill.

[21] Appl. No.: 458,296

[22] Filed: Dec. 28, 1989

[51] Int. Cl.[5] ..... F28F 3/04

[52] U.S. Cl. ..... 165/167; 165/165; 165/166; 165/908

[58] Field of Search ..... 165/165, 166, 167, 908

[56] References Cited

U.S. PATENT DOCUMENTS

| | | | |
|---|---|---|---|
| 3,477,504 | 11/1969 | Colyer et al. | 165/165 |
| 3,823,457 | 7/1974 | Staas et al. | 165/167 |
| 4,445,569 | 5/1984 | Saho et al. | 165/165 |
| 4,494,171 | 1/1985 | Bland et al. | 165/908 |
| 4,624,305 | 11/1986 | Rojey | 165/165 |
| 4,934,454 | 6/1990 | VanDyke et al. | 165/165 |
| 4,936,380 | 6/1990 | Niggemann | 165/167 |

FOREIGN PATENT DOCUMENTS

| | | | |
|---|---|---|---|
| 166779 | 2/1950 | Austria | 165/166 |
| 330727 | 10/1935 | Italy | 165/167 |
| 90592 | 6/1982 | Japan | 165/166 |
| 1621185 | 8/1985 | Japan | 165/166 |
| 80122 | 8/1955 | Netherlands | 165/166 |
| 2019550 | 10/1979 | United Kingdom | 165/167 |

*Primary Examiner*—John Rivell
*Assistant Examiner*—L. R. Leo
*Attorney, Agent, or Firm*—Antonelli, Terry, Stout & Kraus

[57] ABSTRACT

A heat exchanger for exchanging heat between at least a first fluid and a second fluid, with the heat exchanger including an intake and outlet manifold (10, 11, 12, 13) for a first fluid, at least one fluid impingement plate and finned heat exchanger plate (14) for the second fluid, and an end plate manifold, with the plates being stacked so as to form a laminated heat exchanger core. At least one or more spacer plates (15) may be interposed between the respective plates of the heat exchanger core and/or the inlet and outlet manifold (10, 11, 12, 13) and end manifold (18). The first fluid is fed into the inlet and outlet manifold (10, 11, 12, 13) and flows in a first direction through the impingement and finned heat exchanger plates (14) and is redirected by the end manifold (18) toward the inlet and outlet manifold (10, 11, 12, 13). The inlet and outlet manifold (10, 11, 12, 13) and the end manifold (18) are constructed so as to enable a multiple directional change in the flow of the first fluid through the heat exchanger core, with the changes in the flow direction of the first fluid being substantially parallel and orthogonal with respect to the flow of the second fluid through the heat exchanger core.

28 Claims, 9 Drawing Sheets

2ND. FLUID
10
P1
1ST. FLUID
3
4
1ST FLUID
11
11a
11a
12
12a
12a
13c
13
P3
13a
13b
14a
14
14b
2ND. FLUID
15a
15
15"
14a
14"
14
14b
15a
15a
15
15"
18
P2
P4

MULTI-PASS CROSSFLOW JET IMPINGEMENT HEAT EXCHANGER

DESCRIPTION

1. Technical Field

The present invention relates to a heat exchanger and, more particularly, to a completely laminated multi-pass crossflow jet impingement heat exchanger which minimizes if not avoids adverse effects of axial conduction and which reduces overall weight, volume and costs of manufacturing the heat exchanger.

2. Background Art

Various constructions of plate fin heat exchangers have been proposed which are widely used for heat transfer between two fluids either gas or liquid.

Jet plate fin heat exchangers have also been proposed in, for example, commonly-assigned U.S. application Ser. No. 07/280,956, now U.S. Pat. No. 4,880,055, which provide improved performance and also a small lightweight exchanger package by virtue of jet impingement of the fluid which yields heat transfer coefficients several times higher than achievable with plate fin structures for the same expenditure of fluid pumping power.

In proposed jet fin heat exchangers, fluids flow in a counterflow or parallel flow and, in many cases, depending upon a particular application of the heat exchanger, it may be desirable or advantageous to provide for a cross-flow of the fluids.

While a single pass counterflow fin heat exchanger may, for example, be very thin with a large frontal area and of a crossflow configuration as disclosed in, for example, commonly-assigned co-pending U.S. application Ser. No. 07/315,829, a disadvantage of this technical approach resides in the fact that a large amount of ducting is required to feed the fluid into the heat exchanger. Thus, any weight savings which may be gained by using a jet impingement technique in a heat exchanger is completely lost due to the excessive header construction required.

In order to realize a more effective heat exchanging relationship for the fluids as well as a low pressure drop for one of the fluids, in many applications of a heat exchanger, an axial conduction limits the ability of jet fin heat exchangers. Thus, with a single pass cross-flow jet impingement heat exchanger, the heat exchanger would necessarily have a considerable axial length, require many plates, and would be considerably expensive to manufacture In, for example, the U.S. Pat. No. 4,516,632, a microchannel cross-flow fluid heat exchanger is proposed which is formed from a stack of thin metal sheets which are bonded together. The stack of metal sheets consists of alternating slots and unslotted sheets, with each of the slotted sheets including multiple parallel slots forming fluid flow channels when sandwiched between the unslotted sheets. The successive slotted sheets in the stack are rotated by 90° with respect to one another so as to form two sets of orthogonally extending fluid flow channels arranged in a crossflow configuration. While this proposed heat exchanger is a laminated crossflow-type heat exchanger, the heat transfer achieved is plate/plate with a single pass of the fluids.

U.S. Pat. No. 4,729,428 proposes a nonlaminated single pass cross flow plate to plate heat exchanger which includes first and second fluid channels arranged alternately, with each channel being separated from an adjacent channel by a flat metal plate. At least one of the first fluid channel and second fluid channel is formed by a pair of adjacent flat metal plates with a spacer being interposed between the flat plates, which spacer comprises a pair of side walls joined to and interconnecting a pair of opposed edges of the two flat plates at each side thereof. This proposed heat exchanger is fabricated by arranging plates, spacers, fins and spacer bars in layers and joining the parts together by brazing at the same time.

U.S. Pat. No. 4,347,897 proposes a single ass plate-type heat exchanger arranged so that the heat exchange is effected between fluids through the heat transfer plates, with the heat transfer plate serving as heat transfer elements, and jet plates each having a number of small holes. One fluid is jetted through the small holes in the jet plates toward the heat transfer plates opposed to the jet plates, while the other fluid flows along the respective opposite heat transfer surfaces of the heat transfer plates or is jetted toward the respective opposite heat transfer surfaces as with the first fluid In this proposed construction, the fluid directly impinges on the heat transfer surfaces and the construction does not have extended heat transfer surfaces In, for example, U.S. Pat. No. 4,314,607, a counterflow single pass non-laminated plate-type heat exchanger of a continuous plate type is provided which includes a housing having opposed open ends and a thermal transfer cord disposed within the housing. The thermal transfer core is formed of a continuous sheet of heat conductive material folded upon itself on fold regions in opposite directions alternately to define a plurality of substantially parallel mutually spaced sheet portions which extend through the housing. Each of the sheet portions includes a pair of free edge sections located in regions of the respective open ends of the housing, portions of which are sealed together so as to define a first set of fluid flow channels for warm fluid, with each of the first channels having first and second fluid transmitting openings located at the respective open ends of the housing and a second set of fluid flow channels for a cool fluid, each of which has third and fourth fluid transmitting openings located at the respective open ends of the housing.

In, for example, U.S. Pat. No. 4,494,171, an impinging cooling apparatus is proposed, with the impingement cooling principle being carried out by a stack of orifice plates fitted within a housing, with the stack of impingement orifice plates defining a core providing an impinging tortuous path for one or more fluids. A manifold or header is provided at one or both ends of the stack of orifice plates or in the housing to provide a means for distributing the incoming and outgoing fluids to the interior impingement orifice plates.

DISCLOSURE OF INVENTION

The present invention provides a multi-pass crossflow jet impingement heat exchanger which avoids, by simple means, shortcomings and disadvantages encountered in the prior art and which is simple in construction and therefore relatively inexpensive to manufacture.

In accordance with the present invention, a multipass crossflow jet impingement heat exchanger is provided in which two fluids flow in directions which are perpendicular to each other, with one fluid flowing in an upward direction vertically through the heat exchanger and the second fluid flowing in a zig-zag pattern along a horizontal direction back and forth, with the fluid flowing, for example, from right to left and, when reaching the end of the heat exchanger, from left to right, and again from right to left, etc. By virtue of the perpendicular flow of the second fluid relative to the first and the multi-pass arrangement of the present invention, it is possible to realize a heat exchanger having a short axial length in situations where a perpendicular flow is dictated.

In accordance with further advantageous features of the present invention, the first fluid flow provides for a jet impingement flow and a lanced offset flow for the second fluid, with the lanced offset flow being obtained when the fluid flowing upward or perpendicular to the first fluid encounters a plurality of leading edges of fins within a flow path for the second fluid. The jet impingement flow causes the fluid to flow through small holes to impinge against a subsequent wall before again finding an additional small hole and proceeding in this manner throughout the entire heat exchanger.

In accordance with the present invention, there are two modes of heat transfer, namely, an impingement heat transfer and a normal laminar or turbulent heat transfer, with the heat exchanger advantageously being fabricated entirely of a stack of plates including orifice plates, spacer plates, and manifold plates.

According to the present invention, the orifice plates and spacer plates define an impingement plate type heat exchanger for one side of the fluid, with a solid area between a row of circular holes of the orifice plate, and a solid area between the row of rectangular holes of the spacer defining a pattern of the lanced off-set rectangular plate-thin heat exchanger for the other fluid.

According to the present invention, the number of manifold plates depend upon the number of passes and, the number of passes can be advantageously varied for each design requirement of the heat exchanger.

In accordance with further features of the present invention, the end manifold plate may be utilized as a cover and employed to change a direction in transfer fluid from an odd pass to an even pass through the heat exchanger.

In accordance with further features of the present invention, the inlet/outlet manifold plate for the first fluid may be disposed at one end of the stack of plates and include a channel defining a flow passage for distributing the fluid to the flow path from the inlet pipe and collecting the fluid from the last flow path to the outlet pipe, with the inlet/outlet manifold plates also serving to transfer the fluid from the even pass to the odd pass.

According to the present invention, fluid from the inlet path is distributed to- the first pass by the inlet/outlet manifold plates after passing through an array of orifice and spacer plates of a first pass to the end manifold plate. The fluid follows a pattern of the end manifold to the second pass in an inverse direction of the first pass and flows through the array of orifices and spacer of the second pass to the inlet, outlet manifold plates then flows to the third pass, etc. After passing through the last pass, the fluid is collected by the inlet, outlet manifold plates and flows to the outlet pipe.

The other fluid in the heat exchanger, according to the present invention, flows through the lanced offset fin side in a direction to create an overall counterflow heat exchanger.

Advantageously, according to the present invention, the plates may be fabricated by, for example, photoetching and joined together to form a compact heat exchanger structure.

In accordance with still further features of the present invention, an additional spacer may be utilized with the type of additional spacer to be used to increase the thickness of the spacer for some applications limited by the fabrication of the heat exchanger.

The individual plates are configured so as to accommodate any additional spacers which may be needed and, after the plates are joined together to form a core, the ends of the core may be cut off to create flow paths for the plate-thin side of the heat exchanger.

In accordance with the present invention, the heat exchanger for exchanging heat between at least a first and a second fluid may include at least one first plate means forming an inlet and outlet manifold means for the first fluid, with at least one second plate means forming a fluid impingement plate means for the first fluid as well as a finned heat exchanger plate means for the second fluid. At least one third plate means may be provided for forming an end manifold, with the first plate means, second plate means, and third plate means being stacked to form a laminated heat exchanger core. The end manifold means may include a deflecting means or redirecting means by which the flow of the first fluid flowing in a first direction from the inlet and outlet manifold means through the fluid impingement plate means toward the end manifold means is deflected or redirected back toward and through the fluid impingement plate means in at least a second direction toward the inlet and outlet manifold means, with the first and second directions being orthogonal to a flow direction of the second fluid through the finned heat exchanger plate means.

Depending upon the particular requirements of the heat exchanger, advantageously, according to the present invention, a plurality of second plate means may be provided, with each of the second plate means forming a fluid impingement plate means as well as a finned heat exchanger plate means, with the second plate means being stacked between the end manifold means and the inlet and outlet manifold means. Spacer means are advantageously interposed between at least adjacent second plate means between at least the end manifold means and an adjacent second plate means. In such an arrangement, the first fluid flows in a first direction through each of the impingement plate means from the inlet and outlet manifold means and is deflected by the end plate manifold means to flow in the second direction through each of the impingement plate means toward the inlet and outlet manifold means.

Advantageously, the inlet and outlet manifold means and the end manifold means are constructed such that the flow of the first fluid is deflected between the end manifold means and the inlet and outlet manifold means a plurality of times so as to realize a multi-pass of the first fluid through the heat exchanger core, with the respective passes of the first fluid being substantially parallel to each other and orthogonal with respect to the flow of the second fluid through the heat exchanger core.

To facilitate a deflecting of the flow of the first fluid through the heat exchanger core and to provide channels for the flow of the second fluid through the heat exchanger core, advantageously, according to the present invention, the end manifold means is provided with axially and transversely spaced blind openings for receiving the flow of the first fluid from the impingement plate means interposed between the end manifold means and the inlet and outlet manifold means, with the blind opening serving for redirecting the flow back toward the impingement plate means and, toward the inlet and outlet manifold means.

The above and other objects, features, and advantageous of the present invention will become more apparent from the following description when taken in connection with the accompanying drawings which show, for the purpose of illustration only, several embodiments in accordance with the present invention.

BEST MODE FOR CARRYING OUT THE INVENTION

Figure 1:
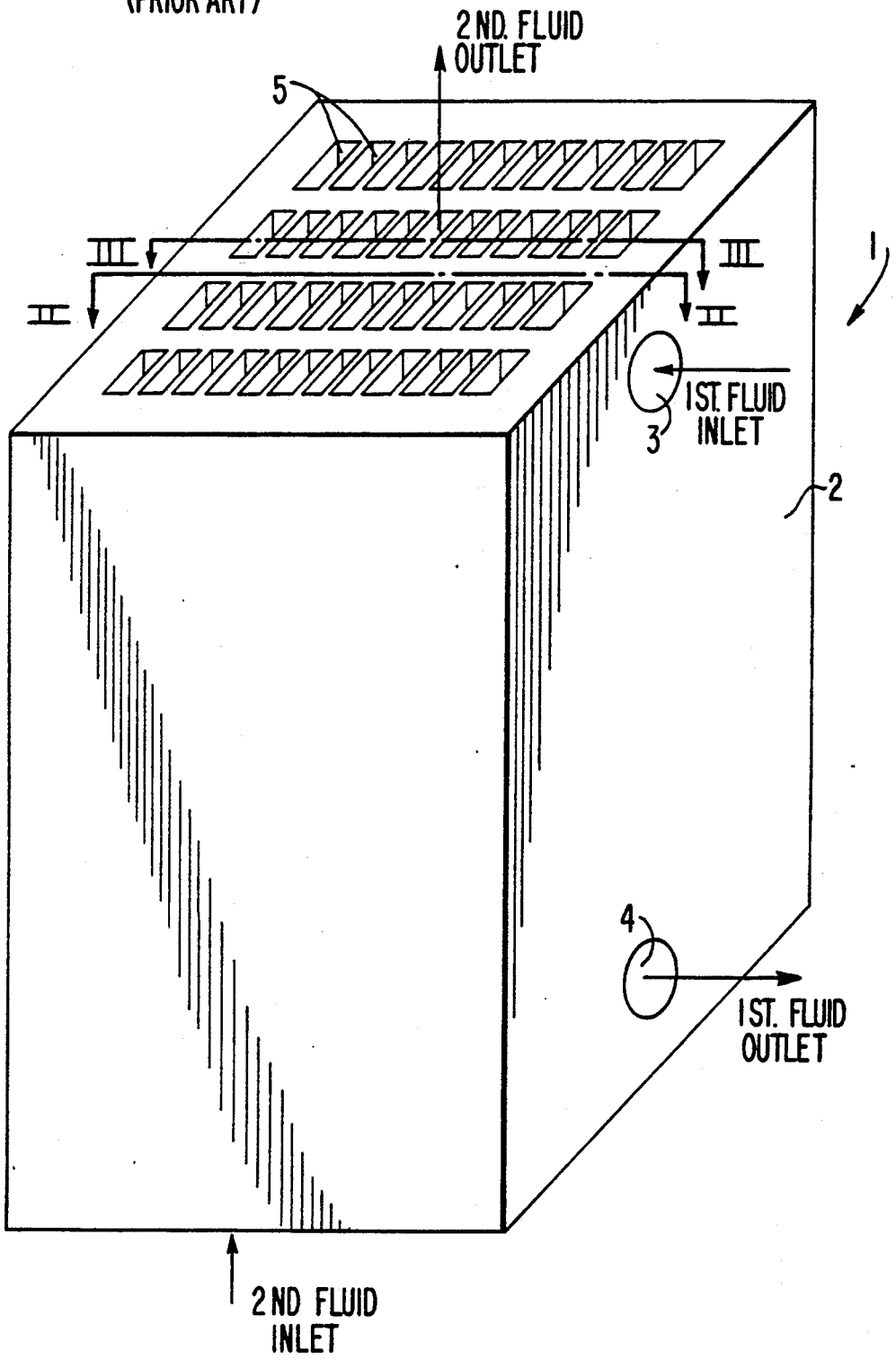
FIG. 1 (PRIOR ART)
FIG. 1 is a schematic perspective view of a typical multi-pass crossflow jet impingement heat exchanger.
Figure 2:
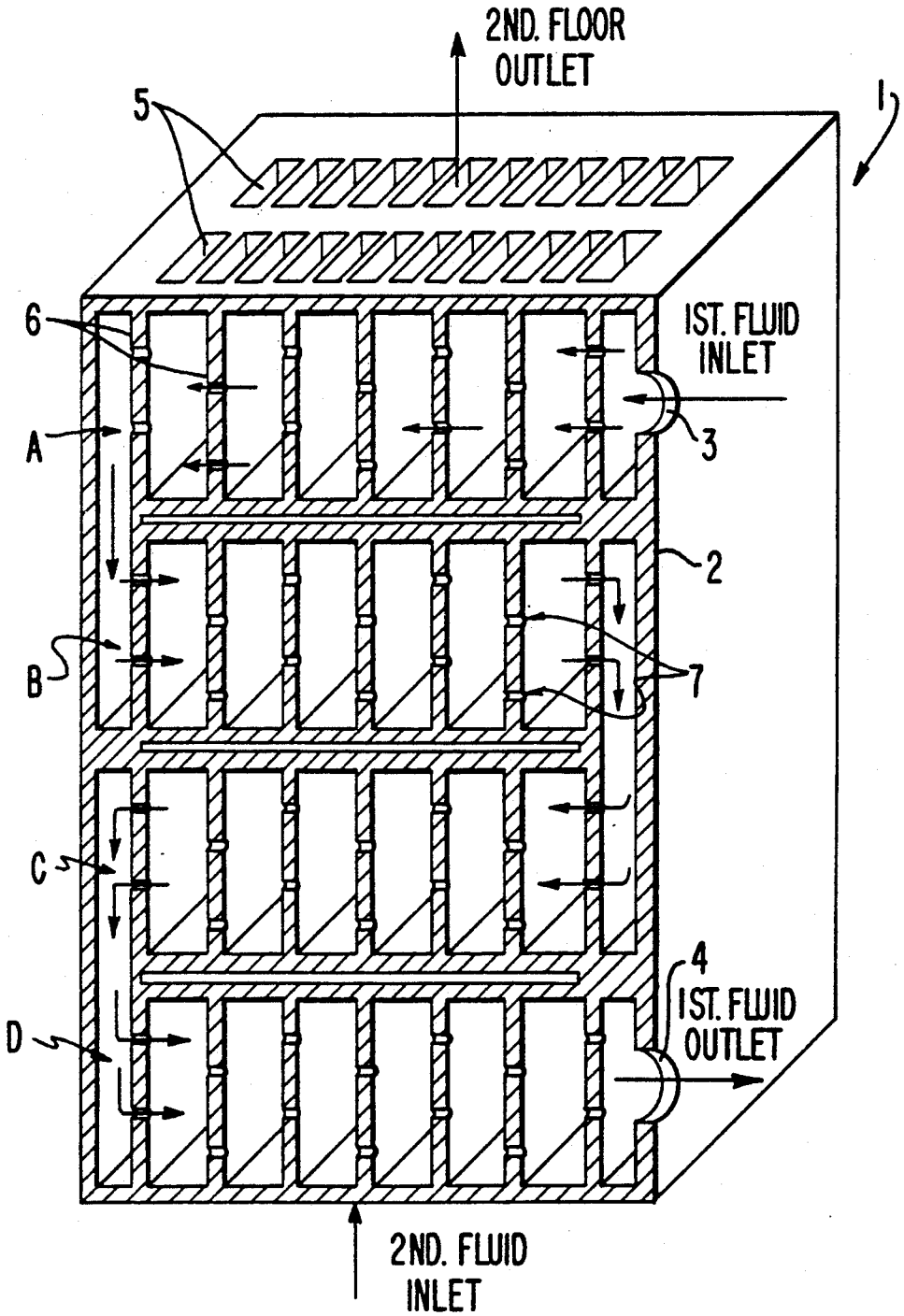
FIG. 2 (PRIOR ART)
FIG. 2 is a cross-sectional view of the heat exchanger taken along the line II—II in FIG. 1 schematically illustrating an impingement flow path.
Figure 3:
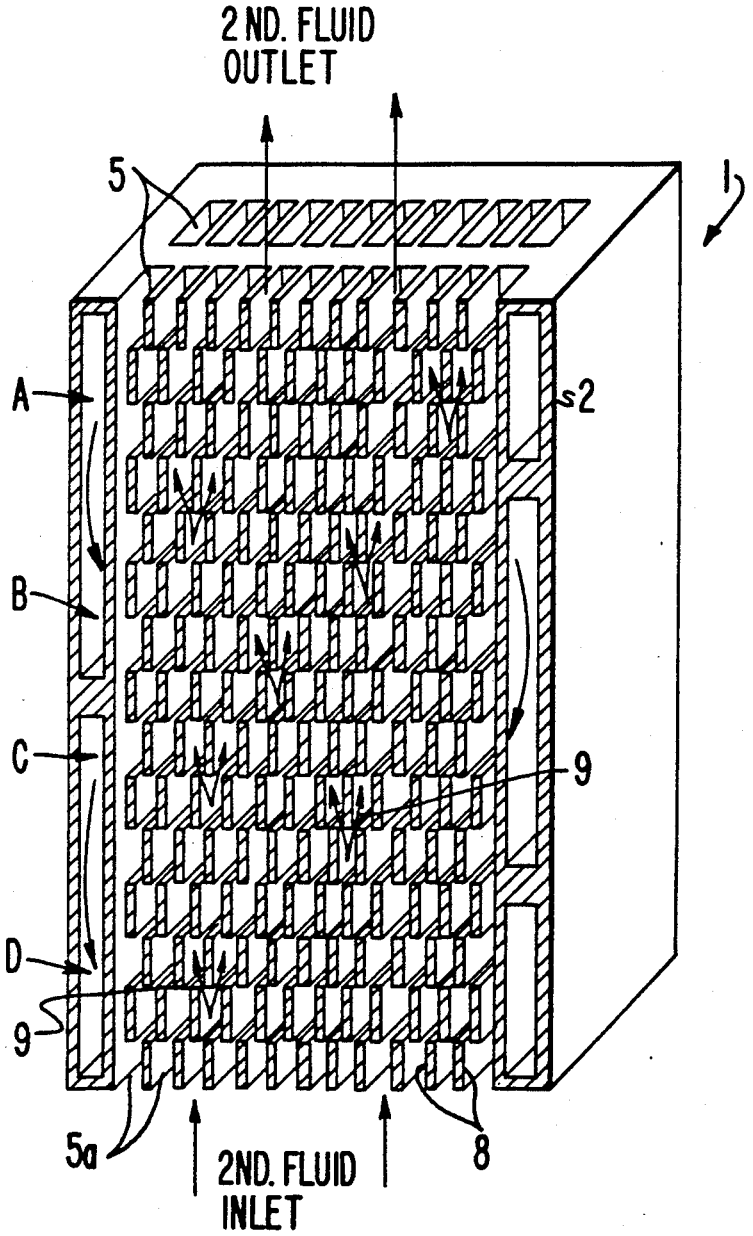
FIG. 3 (PRIOR ART)
FIG. 3 is a cross-sectional view of the heat exchanger taken along the line III—III in FIG. 1 schematically illustrating a plate fin flow path.

Referring now to the drawings wherein like reference numerals are used throughout the various views to designate like parts and, more particularly, to FIGS. 1-3, according to these figures, a conventional heat exchanger generally designated by the reference numeral 1 includes a heat exchanger core 2 accommodating a plurality of impingement plates 6 and fin plates 8, with an inlet port 3 and outlet port 4 being provided in a header portion of the heat exchanger core 2 for respectively receiving and discharging a first fluid. An array of openings 5, 5*a* are respectively provided at opposite ends of the heat exchanger-core 2 and form the outlets and inlets for a second fluid.

As shown most clearly in FIG. 2, the first fluid enters the inlet port 3 and flows through the apertures or openings 7 provided in the impingement plate 6, with the flow of the first fluid having, for example, four passes generally designated by the reference characters A, B, C, D prior to exiting the core 2 of the heat exchanger through the outlet port 4.

As shown most clearly in FIG. 3, the fin plate 8 has a pattern of lanced offset plate fins flowing in the direction of the arrows 9 from the inlet end of the core 2 to the outlet end thereof.

Figure 4:
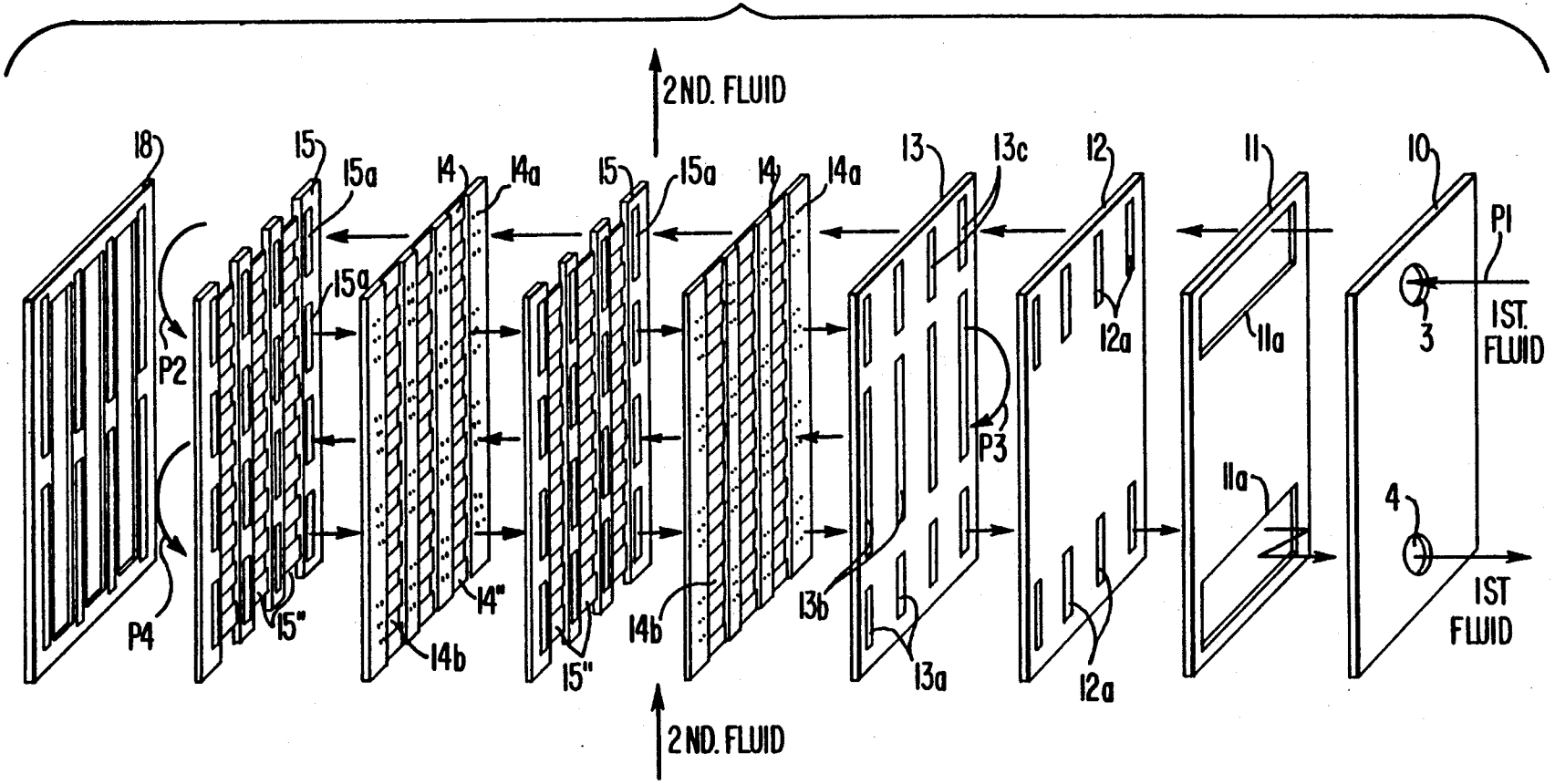
FIG. 4 is a perspective exploded view of the heat exchanger of the present invention.

In accordance with the present invention, as shown most clearly in FIG. 4, a heat exchanger is provided which may include a plurality of individual stacked plates defining a laminated heat exchanger structure, with the plates including a cover plate 10, a first inlet/outlet manifold plate 11, a second inlet/outlet manifold plate 12, a third inlet/outlet manifold plate 13, orifice or impingement plates 14, spacer plates 15, and an end manifold 18. While the heat exchanger of FIG. 4 is illustrated as including nine plates, it is understood that such arrangement is merely exemplary, and the number and arrangement of the stacked plates of the laminated heat exchanger may well vary in dependence upon a particular application of the heat exchanger. Thus, for example, rather than providing the illustrated arrangement of a first orifice or impingement plate 14, first spacer plate 15, second orifice plate 14, second spacer plate 15, and end plate 18, additional orifice or impingement plates 14 may be provided and separated by further spacer plates 15. Moreover, in lieu of or in addition to spacer plates 15, it is also possible to provide one or more additional spacer elements 15*a* (FIG. 12) between an orifice plate and an adjoining spacer plate 15 and/or between an orifice plate and manifold plate 13, with the arrangement and number of the spacer plates 15 and/or spacer elements 15*a* being dictated by, for example, the desired heat exchanging capabilities of the heat exchanger installation space for the heat exchanger, etc.

For exemplary reasons only, the heat exchanger illustrated in FIG. 4 is a four-pass heat exchanger with the first fluid entering the stacked plates through the inlet port 3 and travelling along passes $P_1$, $P_2$, $P_3$, $P_4$; however, as can readily be appreciated, the number of passes for the first fluid through the heat exchanger is dictated by the specific applications and, for example, more or less passes may be provided. Additionally, while only one flow path for the first fluid is illustrated in FIG. 4 for the sake of clarity, it is understood that the first fluid flows through each of the plurality of openings or throughholes in the respective plates 11, 12, 13, 14, 15, and 18 in traversing the four passes $P_1$, $P_2$, $P_3$, $P_4$ prior to exiting the heat exchanger through the outlet port 4.

Figure 5:
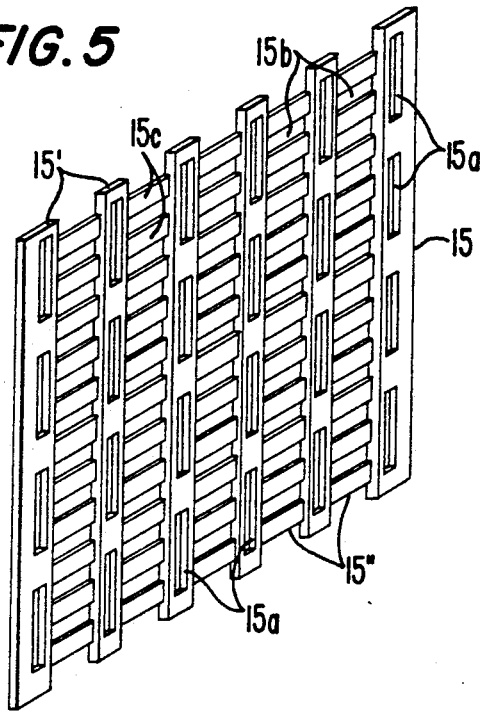
FIG. 5 is a perspective view of a spacer plate for a heat exchanger constructed in accordance with the present invention.

As shown most clearly in FIG. 5, the spacer plate 15 includes a plurality of transversely spaced plate portions 15' having arranged therein a first plurality of spaced throughholes or openings 15*a*. A plurality of fin means 15'' are formed in the spacer plate 15 and extend between adjacent plate portions 15', with the fin means 15'' being spaced from each other so as to define a plurality of spaced second openings or throughholes 15*b* in the spacer plate extending in a direction substantially orthogonally with respect to the first plurality of openings 15*a*.

Figure 6:
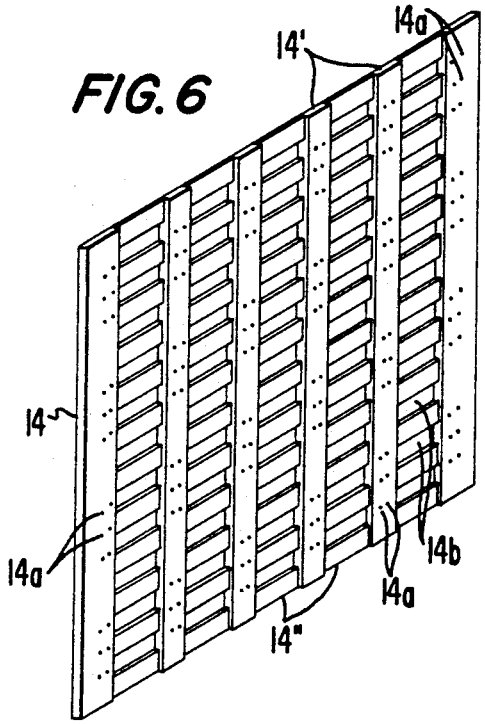
FIG. 6 is a perspective view of an orifice plate for a heat exchanger constructed in accordance with the present invention.

The orifice or impingement plate 14, as shown in FIG. 6, includes a plurality of spaced plate portions 14' having disposed therein a plurality of impingement orifices 14*a* arranged in axially spaced groups. A plurality of fin means 14" are formed in the orifice plate 14 and extend between adjacent plate portions 14', with the fin means 14" being spaced from each other so as to define a plurality of spaced openings or throughholes 14*b* in the orifice plate 14. The spaced plate portions 14' are spaced from each other by a distance corresponding to a distance between adjacent spaced plate portions 15' whereby, upon a stacking of the spacer plate 15 and orifice plate 14, the groups of impingement orifices 14*a* are in registry with the respective throughholes or openings 15*a* in the spacer plate portion 15' of the spacer plate 15. The fin means 14" are arranged so as to be displaced or offset with respect to the fin means 15" when the orifice plate 14 and spacer plate 15 are stacked so as to define a lanced or offset tortuous flow path for the second fluid around the offset fin means 14", 15" from the second fluid inlet end of the heat exchanger to the second fluid outlet end thereof.

Figure 7:
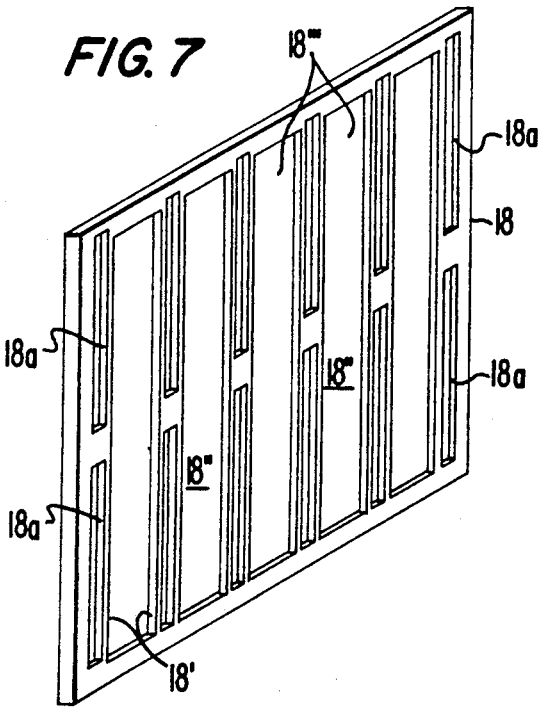
FIG. 7 is a perspective view of an end manifold plate for a heat exchanger constructed in accordance with the present invention.

The end manifold plate 18, as shown in FIG. 7, includes a solid rear wall portion 18" and a plurality of spaced plate portions 18' projecting outwardly from the rear wall portion 18" and forming, with the rear wall portion 18", a plurality of spaced blind recessed portions 18'''. Each of the plate portions 18' include at least a pair of spaced blind openings 18*a* which are 15*a* of the spacer plate 15 when the spacer plate 15 and end manifold plate 18 are stacked with the blind openings 18*a* serving to receive and deflect or redirect the flow of the first fluid back through the orifice or impingement plates 14.

As apparent from the exemplary flow path of the first fluid through the heat exchanger in FIG. 1, fluid flowing through the openings or throughholes 15*a* in the spacer plate 15 adjacent the end manifold plate 18 is deflected in the respective blind openings 18*a* so as to reverse the flow of the first fluid through the heat exchanger at the end manifold plate 18 thereby providing for the respective passes $P_1$, $P_2$, $P_3$, and $P_4$. The second fluid flows in the recessed portions 18''' and about the fins 15" of the spacer plate 15 thereby providing the tortuous path for the second fluid through the heat exchanger at the end manifold plate 18.

Figure 8:
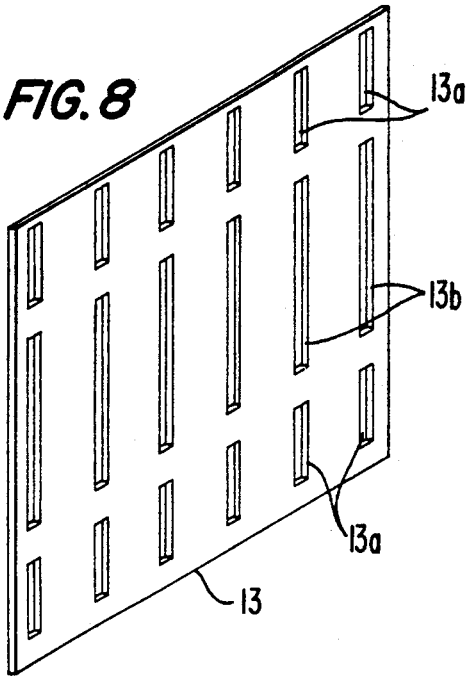
FIGS. 8, 9 and 10 are perspective views of inlet and outlet manifold plates for a heat exchanger constructed in accordance with the present invention.

The inlet/outlet manifold plate 13, as shown in FIG. 8, includes a first plurality of openings or throughholes 13*a* axially and transversely spaced from each other, with a second plurality of openings or throughholes 13*b* arranged between and in substantial alignment with the respective openings or throughholes 13*a*. The first plurality of openings or throughholes 13*a* are transversely spaced from each other by a distance substantially corresponding to a distance between adjacent spaced plate portions 14' of the orifice plate 14 whereby the first fluid flows through the openings or throughholes 13*a* and impinges upon the orifice plate 14, with the first fluid passing through the impingement openings 14*a* in the orifice plate 14 in a direction toward the end manifold plate 18 in one direction of flow of the first fluid, and from the impingement orifice 14*a* through the openings or throughholes 13*a* in an opposite direction of flow of the first fluid away from the end manifold plate 18. The throughholes or openings 13*a* have an axial length or are dimensioned such that the respective openings or throughholes 13*a* are in substantial registry with the respective groups of the impingement orifices 14*a* in the orifice plate 14.

The plurality of throughholes or openings 13*b* of the inlet/outlet manifold plate 13 are arranged so as to be in registry with a plurality of groups of impingent orifices 14*a* of the impingement plate 14 however, in all other respects, the throughholes or openings 13*b* function in the same manner as the throughholes or openings 13*a*.

Figure 9:
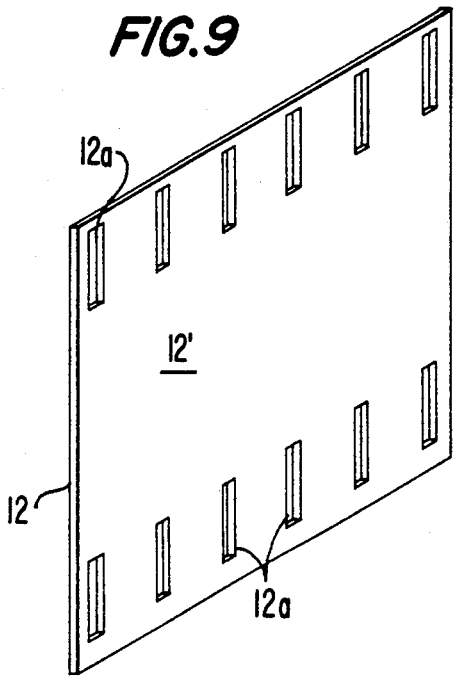

The inlet or outlet manifold plate 12, as shown in FIG. 9 includes a plurality of transversely and axially spaced throughholes or openings 12*a* which are positioned so as to be in registry with the throughholes or openings 13*a* or the inlet/outlet manifold plate 13 thereby permitting a flow of first fluid through the inlet/outlet manifold plate 12 and into and out of the throughholes or openings 13*a* during the first and fourth pass $P_1$, $P_4$ in the illustrated embodiment of FIG. 4.

The inlet/outlet manifold plate 12 includes a solid or imperforate portion 12' which, as shown most clearly in FIG. 1, serves as a deflection or redirection surface for the first fluid, whereby the first fluid flows from the second pass $P_2$ to the third pass $P_3$ through the heat exchanger.

Figure 10:
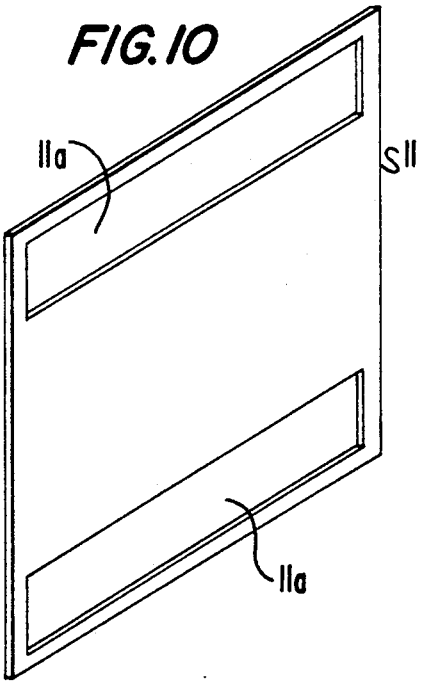

The inlet/outlet manifold plate 11 as shown in FIG. 10 includes a pair of spaced openings or throughholes 11*a* extending substantially across an entire width thereof, with the spaced openings or throughholes 11*a* permitting a flow of first fluid to and from the throughholes or openings 13*a* in the inlet/outlet plate 13 during the first and fourth pass $P_1$, $P_4$ in the illustrated embodiment of FIG. 4.

Figure 11:
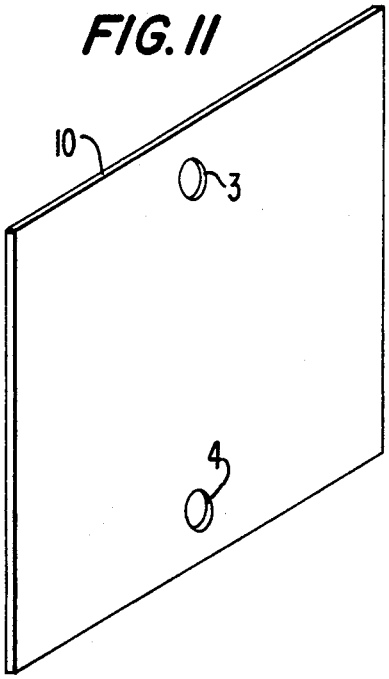
FIG. 11 is a perspective view of a cover plate for a heat exchanger constructed in accordance with the present invention.
Figure 13:
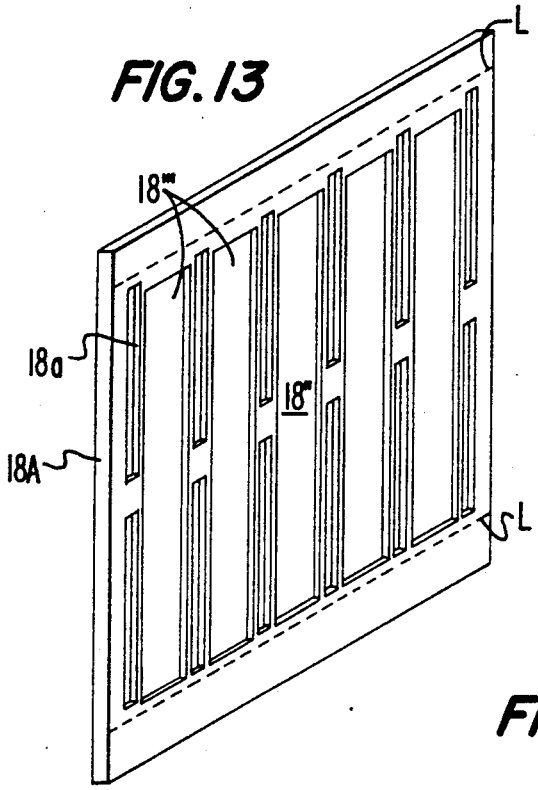
FIG. 13 is a perspective view of an end manifold for a heat exchanger constructed in accordance with the present invention.
Figure 14:
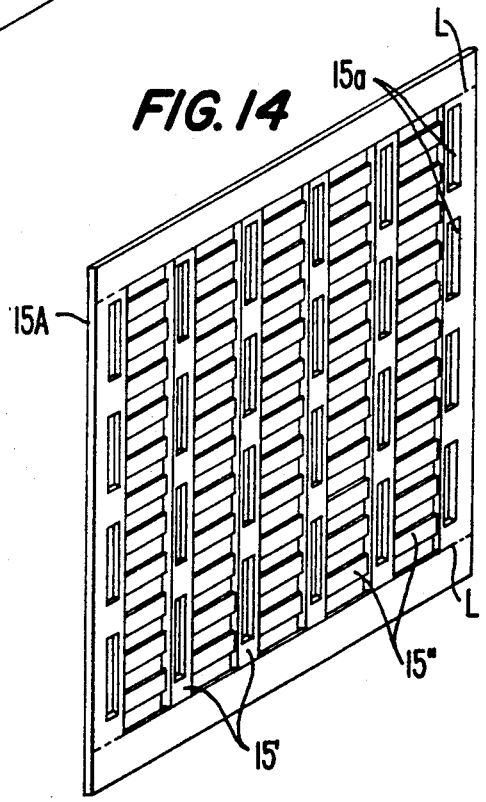
FIG. 14 is a perspective view of a spacer plate for a heat exchanger constructed in accordance with the present invention.

The cover plate 10 is adapted to be disposed at the end of the stacked plates forming the heat exchanger core opposite the end manifold plate 18, with the cover plate 10, as shown most clearly in FIG. 11, including the inlet port 3 and outlet port 4 for the first fluid disposed at a position of the cover plate 10 for communication with the respective openings or throughholes 11*a* in the inlet/outlet manifold plate 11.

When the cover plate 10, inlet/outlet manifold plates 11, 12, 13, orifice plates 14, spacer plates 15, and end manifold plate 18 are stacked to form a laminated heat exchanger as shown in FIG. 4, the first fluid flows on the first pass $P_1$ through the inlet port upper openings 11*a*, 12*a*, 13*a* of the inlet/outlet manifold plates 11, 12, 13, through the first group of impingement orifices 14*a* in the respective orifice plates 14, openings 15*a* in the respective spacer plates 15 to the blind opening 18*a* of the end manifold plate 18. At the blind opening 18*a*, the flow of first fluid is deflected for the second pass $P_2$ through the openings 15*a*, second group of impingement orifices 14*a* to the solid portion 12' of the inlet/outlet plate 12 where the flow of first fluid is once again deflected for the third pass $P_3$ toward the end manifold plate 18. Upon the first fluid reaching the end manifold plate 18 during the third pass $P_3$, the first fluid is once again deflected by the lower blind opening 18*a* of the end manifold plate 18 for the fourth pass $P_4$ through the heat exchanger core in a direction toward the outlet port 4.

While the throughholes or openings 11*a*, 12*a*, 13*a*, 15*a* as well as the blind openings 18*a* have been illustrated as having a substantially quadrangular configuration, it is understood that such illustration is merely exemplary and, for example, the various openings may have other suitable configurations insuring a flow of fluid through the laminated heat exchanger construction. Moreover, the number of openings in the respective plates as well as the number of passes of the fluid through the heat exchanger are solely dictated by factors such as, for example, size of the heat exchanger, nature of the fluid, available installation space, desired heat exchanging capabilities, available pressure drop, etc.

Figure 12:
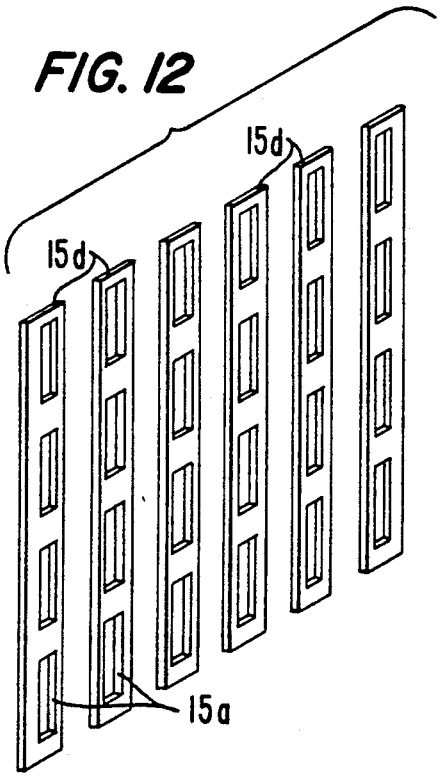
FIG. 12 is a perspective view of a further spacer arrangement for a heat exchanger constructed in accordance with the present invention.
Figure 15:
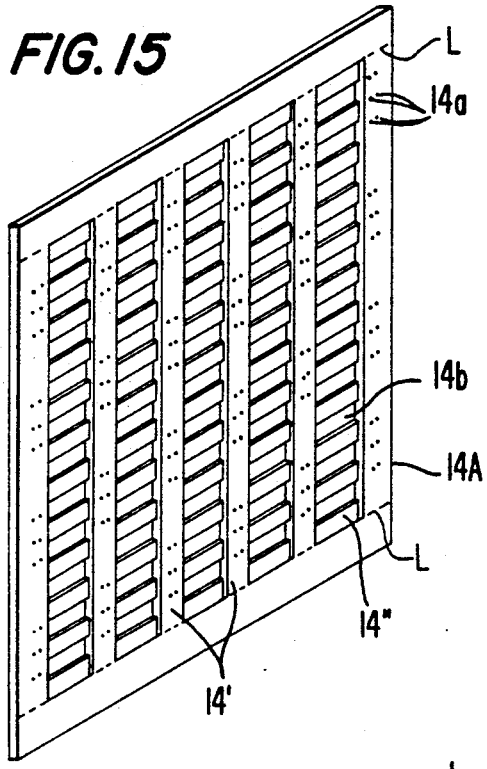
FIG. 15 is a perspective view of an orifice plate for a heat exchanger constructed in accordance with the present invention.
Figure 17:
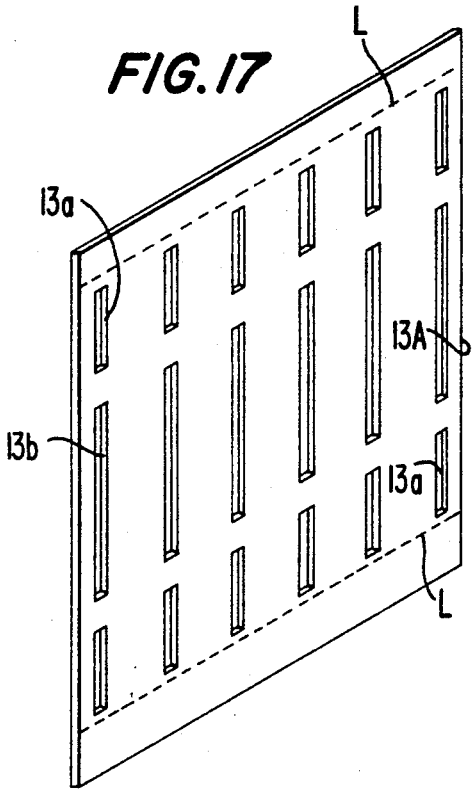
FIGS. 17, 18 and 19 are perspective views of inlet and outlet manifolds for heat exchanger constructed in accordance with the present invention.
Figure 16:
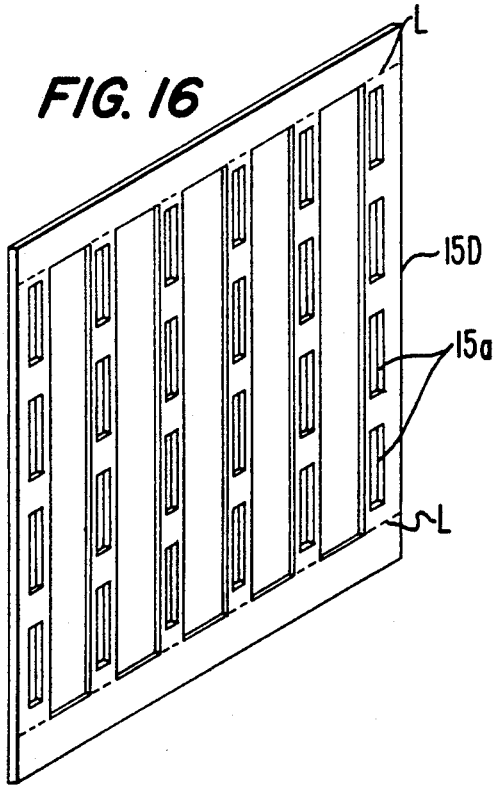
FIG. 16 is a perspective view of an additional spacer for a heat exchanger constructed in accordance with the present invention.
Figure 18:
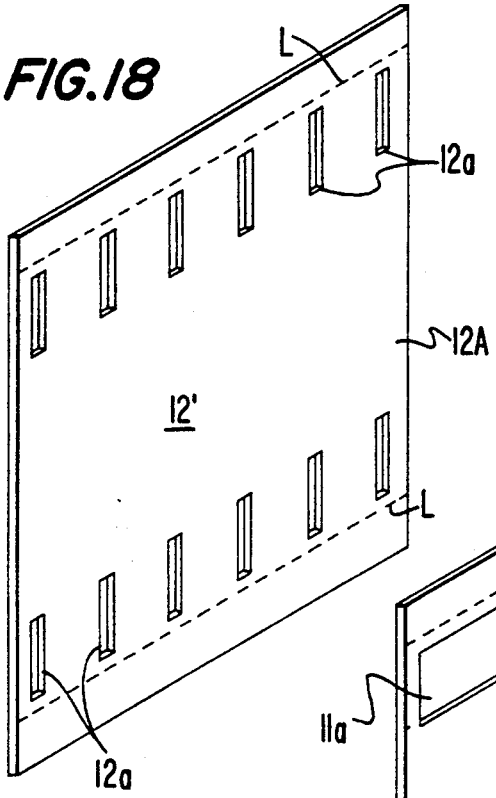
Figure 19:
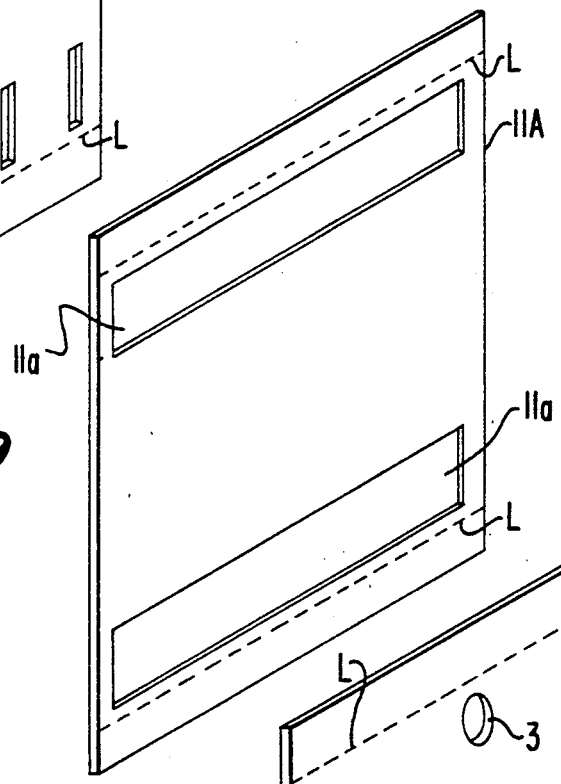
Figure 20:
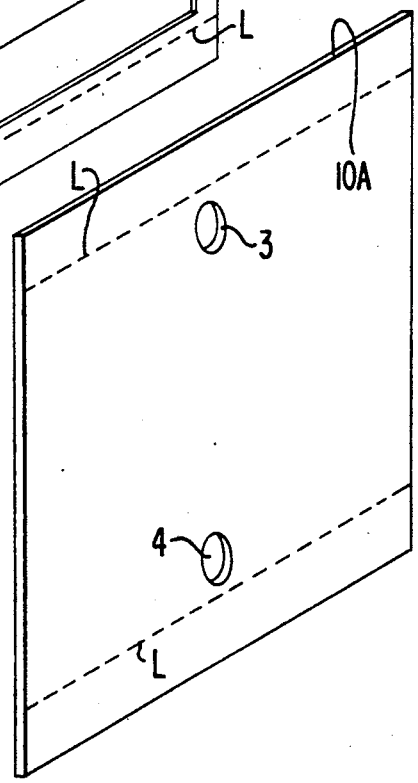
FIG. 20 is a perspective view of a cover plate for a heat exchanger constructed in accordance with the present invention.

For example, as shown in FIG. 12, depending upon fabrication limits, it may be desirable to provide either individual spacer elements 15*d* in lieu of the spacer plate 15 or individual spacer elements 15*d* in addition to the spacer plate 15, with each of the spacer elements 15*d* including a plurality of axially spaced throughholes or openings 15*a*. The individual spacer elements 15*d* are positioned, as shown in FIG. 12, in correspondence with the plate portions 15' of the spacer plate 15. When the individual spacer elements 15*d* are used either in lieu of the spacer plate 15 or in addition thereto, in order to facilitate fabrication of the laminated heat exchanger of the present invention, and end manifold plate 18A, spacer plate 15A, orifice plate 14A, spacer plate 15D, an inlet/outlet plates 13A, 12A, 11A, and 10A may be provided as respectively shown in FIGS. 13–20, with each of the plates being provided with a cutting or severing line L. After the plates are stacked and joined together to form a heat exchanger core, the respective ends of the plates are cut, severed, or otherwise removed along the lines L to create flow paths for the second fluid.

While I have shown and described several embodiments in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A heat exchanger for exchanging heat between at least a first fluid and a second fluid, the exchanger including at least one first plate means forming an inlet and outlet manifold means for the first fluid, at least one second plate means forming a fluid impingement plate means for the first fluid and a finned heat exchanger plate means for the second fluid, and at least one third plate means for forming an end manifold means, said fluid impingement plate means including a plurality of spaced orifice means for enabling a flow of the first fluid through said fluid impingement plate means, said at least one first, second and third plate means being stacked to form a laminated heat exchanger core, said end manifold means including means for deflecting the flow of the first fluid flowing in a first direction from said impingement plate means back toward an through said fluid impingement plate means in at least a second direction toward said inlet and outlet manifold means and a plurality of spaced recess means for forming channel means for the flow of the second fluid, and wherein said first and second directions are orthogonal to a flow direction of the second fluid through said finned heat exchanger plate means.

2. A heat exchanger according to claim 1, wherein said inlet and outlet manifold means includes means for deflecting the flow of the first fluid flowing in the second direction to a third direction through said impingement plate means toward said end manifold means, said end manifold means being adapted to deflect the flow of the first fluid flowing in the third direction to a fourth direction through said impingement plate means toward said inlet and outlet manifold means, and wherein said flow in said first, second, third, and fourth directions are substantially parallel to each other and orthogonal to the flow of the second fluid through said thin heat exchanger plate means.

3. The heat exchanger according to claim 2, wherein said inlet and outlet manifold means includes a cover plate having at least one inlet port and at least one outlet port for accommodating the first fluid, and wherein said means for deflecting the flow of the first fluid in the third direction includes a solid plate portion of said inlet and outlet manifold means interposed between the inlet port and the outlet port.

4. The heat exchanger according to claim 3, wherein the finned heat exchanger plate means includes a plurality of fins spaced axially and transversely of the finned heat exchanger plate means, said fins being separated in a transverse direction of said finned heat exchanger plate means by a plate portion of the finned heat exchanger plate means so as to define a plurality of flow channels for the second fluid thereby permitting the second fluid to flow through said heat exchanger core, and wherein said plurality of orifice means are provided in said plate portion.

5. The heat exchanger according to claim 4, wherein said means for deflecting includes a plurality of blind openings for receiving the flow of the first fluid from the impingement plate means and redirecting the flow toward the impingement plate means.

6. The heat exchanger according to claim 5, further comprising at least one fourth plate means forming a spacer plate interposed between the end manifold means and the impingement plate means, said spacer plate including opening means communicating with the orifice means and with at least one of the blind openings in the end manifold means for enabling the first fluid to flow from the impingement plate means toward the end manifold plate means.

7. The heat exchanger according to claim 6, wherein the spacer plate includes a plurality of fin means offset with respect to the fins of the finned heat exchanger plate means, said fin means being separated in a transverse direction of the spacer plate by plate portions so as to define flow channels for the second fluid, and wherein said opening means in said spacer plate are disposed in said plate portion of said spacer plate.

8. The heat exchanger according to claim 7, further comprising at least one fifth plate means forming a further spacer plate interposed between the impingement plate means and the inlet and outlet manifold means, said further spacer plate including opening means communicating with the orifice means and with the inlet port and outlet port of the cover plate of the inlet and outlet manifold means for enabling a flow of the first fluid through the heat exchanger core means.

9. The heat exchanger according to claim 8, wherein said further spacer plate includes a plurality of fin means offset with respect to the fins of the finned heat exchanger plate means, and wherein said plurality of fin means are spaced axially and transversely of the further spacer plate and separated in a transverse direction of said further spacer plate by plate portions so as to define flow channels for the second fluid.

10. The heat exchanger according to claim 9, further comprising at least one-sixth plate means forming a second fluid impingement plate means for the first fluid and second finned heat exchanger plate means for the second fluid, said second fluid impingement plate means including a plurality of spaced orifice means for enabling a flow of fluid therethrough, said second fluid impingement plate means being interposed between said inlet and outlet manifold means and said further spacer plate, and wherein at least some of said orifice means in said second fluid impingement means are in communication with the opening means of said further spacer plate and the inlet port and outlet port of the inlet and outlet manifold means.

11. The heat exchanger according to claim 10, wherein said second finned heat exchanger plate mean includes a plurality of fins spaced axially and transversely of the second heat exchanger plate means, said fins being separated in a transverse direction of said second heat exchanger plate means by plate portions of the second heat exchanger plate means so a to define a plurality of flow channels for the second fluid thereby permitting the second fluid to flow through said heat exchanger core.

12. The heat exchanger according to claim 11, wherein said inlet and outlet manifold means further includes at least one first inlet and outlet manifold plate provided with at least two spaced openings communicating with the orifice means of said second fluid impingement plate means, said first inlet and manifold plate being interposed between said cover plate and said second fluid impingement plate means.

13. The heat exchanger according to claim 12, wherein said inlet and outlet manifold means further includes at least one second inlet and outlet manifold plate provided with a plurality of openings communicating with the openings of said first inlet and outlet manifold plate, said second inlet and outlet manifold plate being interposed between said first inlet and outlet manifold plate and said second fluid impingement plate means.

14. The heat exchanger according to claim 13, wherein said inlet and outlet manifold means further includes at least one third inlet and outlet manifold plate provided with a plurality of spaced openings, at least some of said openings in said third inlet and outlet manifold plate communicating with at least some of said openings in said second inlet and outlet manifold plate.

15. The heat exchanger according to claim 14, wherein said solid plate portion of said inlet and outlet manifold means is formed between the plurality of openings of said second inlet and outlet manifold plate.

16. The heat exchanger according to claim 1, wherein a plurality of second plate means are provided each forming a fluid impingement plate means with a plurality of orifice means for the first fluid and a finned heat exchanger plate means for the second fluid, said plurality of second plate means being stacked between said end manifold means and said inlet and outlet manifold means, spacer means are interposed between at least adjacent second plate means and between at least the end manifold means and an adjacent second plate means, and wherein the first fluid flows in the first direction through each of the impingement plate means and is deflected by the end plate manifold means to flow in the second direction through each of the impingement plate means toward the inlet and outlet manifold means.

17. The heat exchanger according to claim 16, wherein the inlet and outlet manifold means includes a means for deflecting the flow of the first fluid flowing in the second direction back through each of the impingement plate means toward the end manifold means for at least one further deflection of the flow of the first fluid by the end manifold means prior to flowing out of the inlet and outlet manifold means.

18. The heat exchanger according to claim 16, wherein the inlet and outlet manifold means includes means for deflecting the flow of the first fluid flowing through the heat exchanger core, said means for deflecting provided at said end manifold means and said means for deflecting provided at said inlet and outlet manifold means being constructed such that the flow of the first fluid is deflected between said means for deflecting provided at said end manifold means and of said inlet and outlet manifold means a plurality of times with the changes and direction of flow the first fluid being substantially parallel and orthogonal to the flow of the second fluid through the heat exchanger means.

19. The heat exchanger according to claim 18, wherein each of said finned heat exchanger plate means includes a plurality of fins spaced axially and transversely of the respective heat exchanger plate means, said fins being separated in a transverse direction of the respective heat exchanger plate means by a plate portion so as to define a plurality of flow channels for the second fluid thereby permitting the second fluid to flow through said heat exchanger core, and wherein said plurality of orifice means are provided in said plate portions.

20. The heat exchanger according to claim 19, wherein said means for deflecting provided at said end manifold means includes a plurality of axially and transversely spaced blind openings for receiving the flow of first fluid from the impingement plate means and redirecting the flow back toward the impingement plate means.

21. The heat exchanger according to claim 20, wherein the number of axially spaced blind openings corresponds to the number of flow paths of the first fluid through the heat exchanger core.

22. The heat exchanger according to claim 20, wherein said spacer means respectively include a spacer plate comprising openings means communicating with the orifice means and with the respective blind openings for enabling a flow of the first fluid through said spacer plates.

23. The heat exchanger according to claim 22, wherein each of said spacer plates includes a plurality of fin means offset with respect to fins of adjacent finned heat exchanger plate means, said fin means being separated in a transverse direction of the respective spacer plates by plate portion so as to define channels for the second fluid, and wherein said opening means are disposed in said plate portions of the respective spacer plates.

24. The heat exchanger according to claim 23, wherein said inlet and outlet manifold means includes a cover plate having at least one inlet port and at least one outlet port for accommodating the first fluid, and wherein said means for deflecting provided at said inlet and outlet manifold includes a solid plate portion interposed between the inlet and outlet port.

25. The heat exchanger according to claim 24, wherein said inlet and outlet manifold means further includes at least one first inlet and outlet manifold plate interposed between the cover plate and one of said impingement plate means, said first inlet and outlet manifold plate including at least two spaced openings communicating with the orifice means of the fluid impingement plate means and with the inlet and outlet port of said cover plate.

26. The heat exchanger according to claim 25, wherein said inlet and outlet manifold means further includes at least one second inlet and outlet manifold plate provided with a plurality of openings communicating with the openings of said first inlet and outlet manifold plate, said second inlet and outlet manifold plate being interposed between said first inlet and outlet manifold plate and a fluid impingement plate means.

27. The heat exchanger according to claim 26, wherein said inlet and outlet manifold means further includes at least one third inlet and outlet manifold plate provided with a plurality of spaced openings, at least some of said openings in said third inlet and outlet manifold plate communicating with at least some of the openings in said second inlet and outlet manifold plate, and wherein said third inlet and outlet manifold plate is interposed between said second inlet and outlet manifold plate and impingement plate means.

28. The heat exchanger according to claim 27, wherein said means for deflecting of said inlet and outlet manifold means includes a solid plate portion provided between the plurality of openings of said second intake and outlet manifold plate.

* * * * *